United States Patent [19]

Scribner

[11] Patent Number: 4,531,662

[45] Date of Patent: Jul. 30, 1985

[54] CONTROLS FOR DUPLEX FEEDERS

[76] Inventor: Albert W. Scribner, 6 Country Club Rd., Darien, Conn. 06820

[21] Appl. No.: 496,055

[22] Filed: May 19, 1983

[51] Int. Cl.[3] ..... B65H 17/36

[52] U.S. Cl. ..... 226/159; 226/162

[58] Field of Search ..... 226/111, 116, 122, 134, 226/145, 146, 149, 150, 158, 159, 162; 83/227

[56] References Cited

U.S. PATENT DOCUMENTS

| | | | |
|---|---|---|---|
| 2,228,245 | 1/1941 | Barker et al. | 226/150 X |
| 2,406,508 | 8/1946 | Papsdorf | 226/162 X |
| 3,157,334 | 11/1964 | Bunnell et al. | 226/150 |
| 3,485,430 | 11/1969 | Scribner | 226/150 X |
| 3,561,309 | 2/1971 | Scribner | 226/162 X |
| 3,583,268 | 6/1971 | Scribner | 226/162 X |
| 3,753,522 | 8/1973 | Voges | 226/162 X |
| 3,847,320 | 11/1974 | Scribner | 226/162 X |
| 4,051,987 | 10/1977 | Scribner | 226/162 X |
| 4,076,161 | 2/1978 | Scribner | 226/151 X |
| 4,160,518 | 7/1979 | Scribner | 226/162 X |
| 4,175,688 | 11/1979 | Scribner | 226/158 |
| 4,195,761 | 4/1980 | Scribner | 226/115 |
| 4,223,821 | 9/1980 | McCall | 226/150 X |
| 4,290,541 | 9/1981 | Scribner | 226/150 |
| 4,310,114 | 1/1982 | Scribner | 226/162 |
| 4,329,897 | 5/1982 | Scribner | 226/162 X |

FOREIGN PATENT DOCUMENTS 1027169 5/1953 Fed. Rep. of Germany .

OTHER PUBLICATIONS

Soepnel, A. P. J., Industrie-Anzeiger, Essen, Nr. 75, Sep. 19, 1961, pp. 1435-1438.

*Primary Examiner*—Harvey C. Hornsby
*Assistant Examiner*—Scott J. Haugland

[57] ABSTRACT

A duplex feeder having two separate complementary stock feeding units each having its own independent semi-automatic control circuit, these two separate control circuits being alternately operated by a demand feed signal generating means that is adapted to be responsive to the successive operative cycles of the press with which the feeder is to be used whereby a first operative cycle of the press causes just a first one of said feed units to move through a feed-index cycle of movement so as to advance the stock through a first incremental feed step and whereby the next operative cycle of the press causes just the second one of said feed units to move through a feed-index cycle of movement so as to advance the stock through its next incremental feed step. Also provided for the feeder is a buffer system wherein the normal exhaust flow conditions for each of the two main fluid motor means for the two feed units respectively is modified in response to the terminal portion of the feed stroke of each of the two feed slides of said feed units so as to thereby cause said main fluid motor means to afford a cushioning action during the arresting of each of said feed slides during the terminal portions of the successive stock feed strokes thereof.

6 Claims, 3 Drawing Figures

Fig. 2
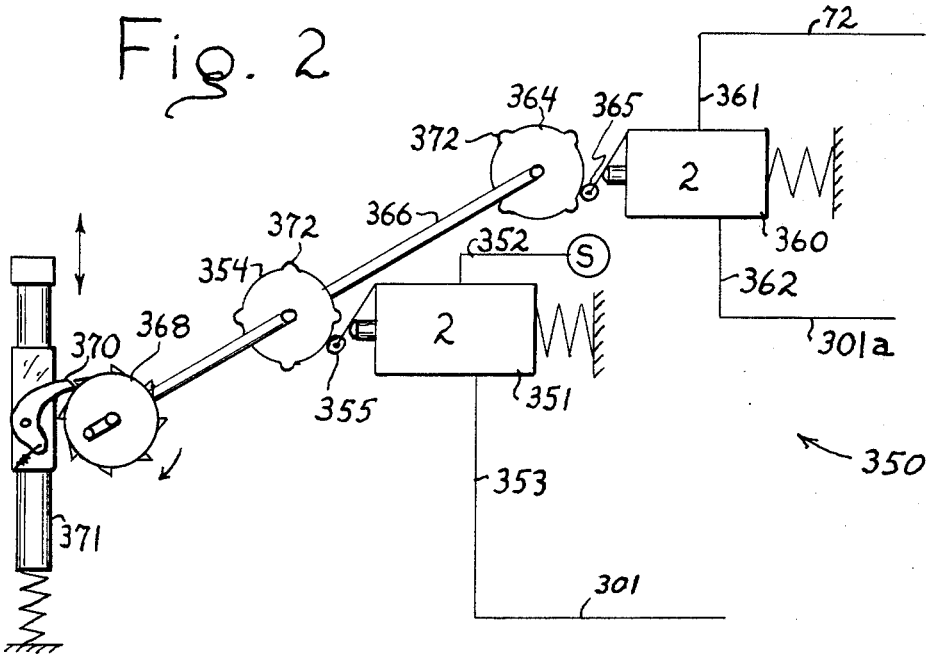
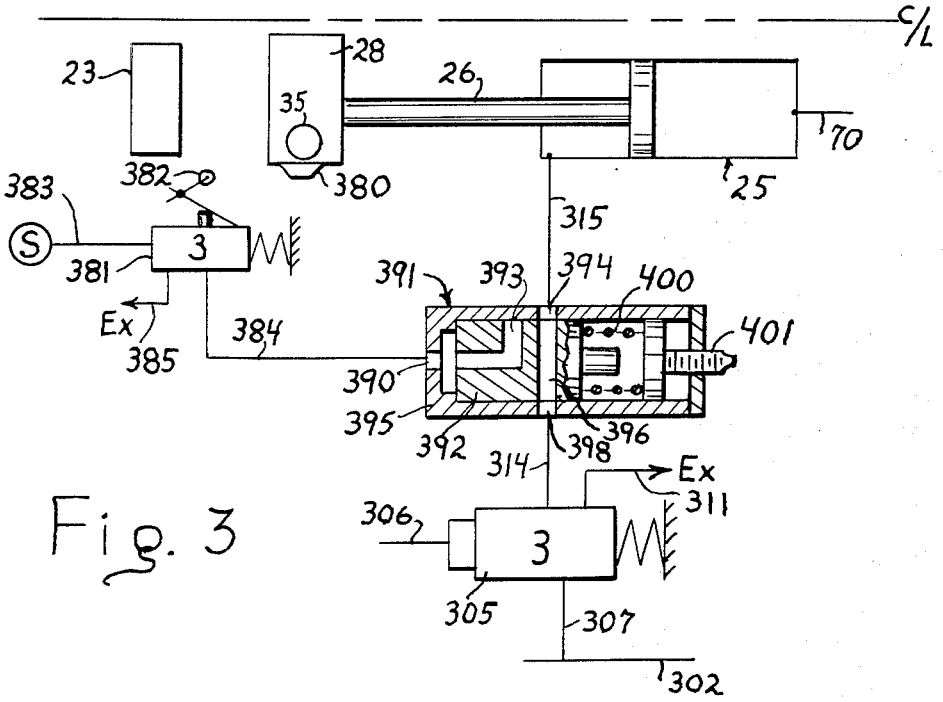
Fig. 3

CONTROLS FOR DUPLEX FEEDERS

BACKGROUND OF THE INVENTION

In high performance duplex feeders maximum utilization must be made of the stock feed time available during each cycle of operation of the punch press with which the feeder is used, and to accomplish this it is desirable in some cases to have each of the feed units essentially physically and operationally independent of one another so that each of the two feed slides may commence an index stroke as soon as possible after completing its feed stroke and without having to wait until the time that the other feed slide starts its feed stroke. Also for the high performance of duplex feeders, particularly for larger feeder sizes, it is necessary to have a high capacity buffer system whereby the high speed feed motion of each feed slide and the stock being carried thereby may be rapidly decellerated in a smooth efficient manner at the end of each stock feed stroke.

SUMMARY OF THE INVENTION

The present invention contemplates an improved control for a duplex feeder wherein each of the two stock feed units is controlled by an independent semi-automatic control circuit and wherein both of these two independent circuits are in turn controlled by a demand feed signal generating means that is adapted to be actuated in response to the successive operative cycles of the punch press with which the duplex feeder is used. The signal generating means operates to direct successive demand feed signals alternatively to said one and then to the other of said separate semi-automatic control circuits so that said two stock feed units alternately and incrementally advance the strip stock into the work station of said press.

The invention further contemplates the provision of an improved fluid operated buffer system whereby the two main fluid motor means for respectively actuating the two feed slides of said feed units are controlled so as to temporarily act as buffers during the terminal portions of each successive stock feed stroke of said feed units. This fluid controlled buffer system operates so as to inhibit, at the desired time during each stock feed stroke, the normal fluid exhaust flow from one end of the main fluid motor means, this interruption in said normal exhaust flow serving to afford a substantial decelleration or cushioning for the terminal portion of each feed stroke of said feed slides.

DETAILED DESCRIPTION OF THE DRAWINGS

FIG. 2 is a perspective view illustrating the nature of the signal generating means for the two separate semi-automatic control circuits for the two stock feed units of the present duplex feeder.

FIG. 3 is a circuit diagram illustrating an alternate buffer control means for the present duplex feeder.

DETAILED DESCRIPTION OF THE INVENTION

Figure 1:
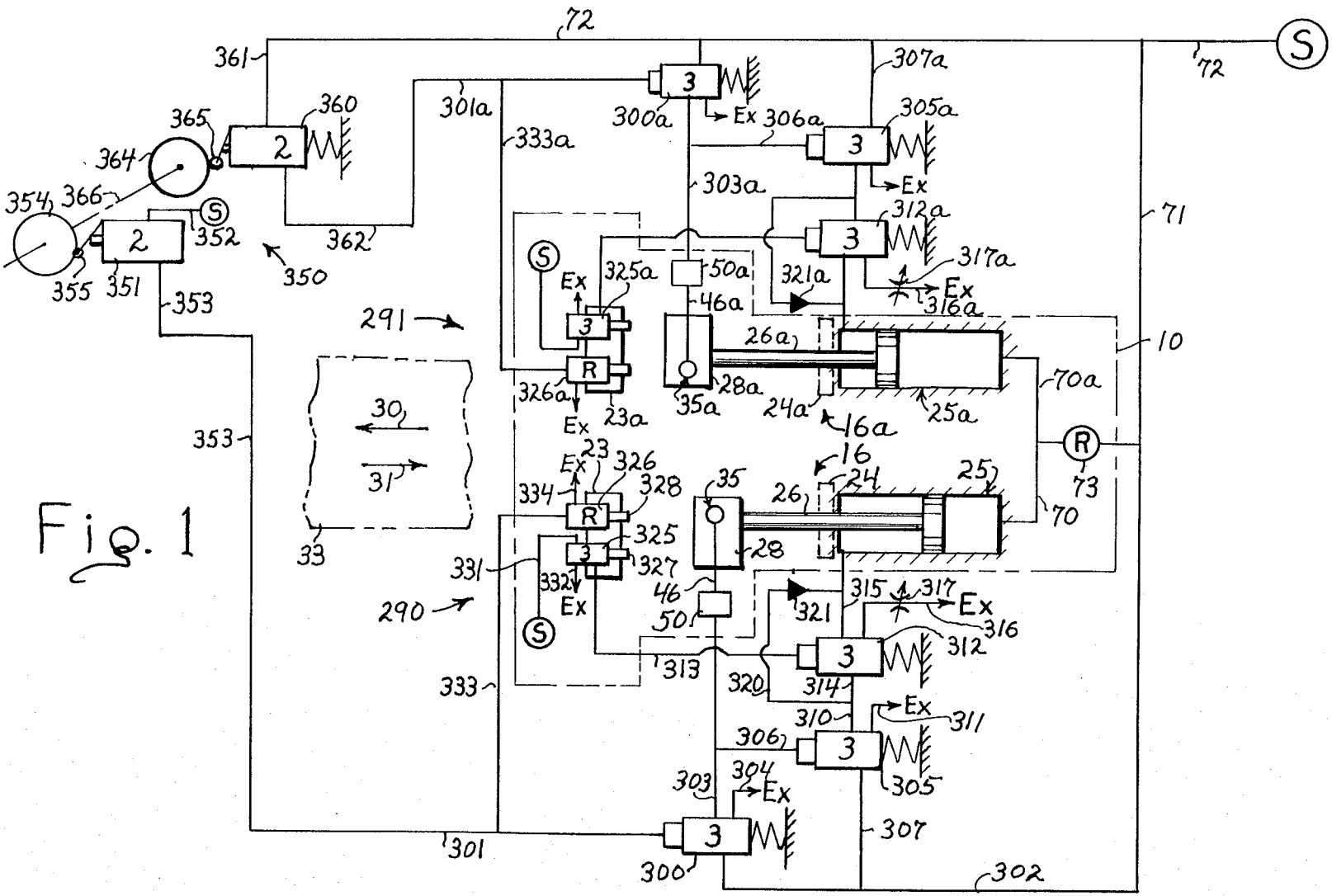
FIG. 1 is a circuit diagram illustrating the improved semi-automatic and buffer controls for the present duplex feeder.

The present feeder includes a transport section 10, FIG. 1 and a control section. The transport section 10 used here may be of any suitable type disclosed by the prior art; however for the purposes of illustration such will be considered here to be identical to the transport section 10 shown and described in FIGS. 1–3 of my copending application Ser. No. 496,056, filed of even date herewith, and entitled "Duplex Feeder Controls". The content of said copending application is incorporated herein by reference and may be referred to for an understanding of the structural and functional details of said transport section 10. For convenience the reference numerals used for the several parts of the feeder transport section shown herein will be the same as those used for the corresponding parts of the said section 10 described in said copending application. A brief review of the structural and functional aspects of this transport section will be made with reference to FIG. 1 wherein a first stock feed unit 16 is provided and comprises a feed slide 28 that is adapted to be reciprocated by a main fluid motor 25 in feed and index directions 30 and 31 respectively between fixed stops represented by end blocks 23 and 24. During movement in the feed direction 30 the stock gripping fluid motor 35 is actuated so that the stock 33 may be gripped and advanced with the feed slide 28 through a first incremental feed step. During the subsequent movement of the slide 28 in an index direction 31 the stock gripping fluid motor 35 is deenergizedso that no stock feed action occurs during the index movement of said slide 28. A second stock feed unit **16*a* is provided which comprises a feed slide 28*a* which is constructed and operated in a manner similar to that just described for feed slide 28. The feed slides 28 and 28*a* are adapted to be controlled and actuated so as to alternately advance the stock 33 into the work station of the punch press with which the present duplex feeder is to be used. The head ends of the main fluid motors 25 and 25*a* are adapted to be continuously fluid biased through lines 70 and 70*a*, Regulator 73, and lines 71 and 72** from the pressure air supply source S as described in said copending application.

The control section of the present invention includes two independent semi-automatic control circuits 290 and 291 for said feed units 16 and **16*a* respectively, and since they are alike a description of only one of said circuits will suffice here. The control circuit 290 for the first stock feed unit 16 includes a first pilot-operated spring-returned normally-closed (i.e. normally exhausting) 3-way valve 300 having a demand feed signal pilot control line 301, an air supply inlet line 302, and output line 303, and an exhaust line 304. The line 304 is connected to the line 63 for controlling the air-hydraulic pumping means 50 for the hydraulic stock gripping motor means 35 carried by said feed slide 28 as is more fully described in copending application. A second pilot-operated spring-returned normally-open 3-way valve 305 is provided having a pilot control line 306 connected to said output line 303, an air supply inlet line 307 connected to said supply line 302, and output line 30 and an exhaust line 311. A third pilot-operated spring-returned normally-open 3-way valve 312 is provided having a pilot control line 313, an air supply inlet line 314 connected to said line 310, an output line 315 connected to the rod end of the main fluid motor 25, and an exhaust line 316 having operatively disposed therein a variable fluid flow restriction means 317 of any suitable type. A by-pass line 320 connected between line 314 and 315 has operatively disposed therein a one-way or check valve 321**.

Two valves 325 and 326 are mounted on the forward end block 23, these valves respectively having control plungers 327 and 328 that are both adapted to be operated by and during the terminal portions of each successive feed stroke of the feed slide 28. The valve 325 is a conventional type normally-closed 3-way valve having an output line 330 connected to said pilot control line 313, an air supply inlet line 331 and an exhaust line 332. The valve 326 is a conventional type normally-closed (i.e. preventing fluid flow therethrough) 2-way valve having an inlet line 333 connected to said pilot control line 301, and an exhaust line 334.

The operation of the said first semi-automatic control circuit 290 will not be described. In the normal condition of the circuit the valves 325 andd 326 will be in their normally closed conditions and thus valve 300 will be in its normally closed condition so that the stock gripping motor means 35 will be in a stock release condition. At this time valves 305 and 312 will also be in their normally-open conditions so that supply pressure fluid from line 302 may enter the rod end of said main fluid motor 25 and thus move the feed slide 28 to its normal indexed or right hand (as seen in FIG. 1) position, determined by a stroke adjusting screw carried by the said end block 24, wherein it is ready on demand to commerce a stock feed stroke. When a demand feed signal or pulse is initiated in line 301 (i.e. when line 301 is pressurized) in the manner to be described below feed slide 28 will be moved through a feed-index cycle wherein the slide moves from a normal indexed or right hand (as seen in FIG. 1) position through a stock feed stroke and then automatically reverses and moves through a non-feed or index stroke back to its said normal position. More specifically, said signal will cause the valve 300 to be shifted to an open condition so that the resultant flow of pressure fluid into the output line 303 will cause stock gripping fluid motor 35 to be actuated so that the stock gripping means on slide 28 is moved to a stock gripping condition. Pressure fluid in line 303 will, through control line 306, cause valve 305 to be shifted to a closed condition so that pressure fluid from the rod end of fluid motor 25 may exhaust through line 315, the open valve 312, lines 314, 310 and through valve 305 and its exhaust line 311. This exhausting of the relatively high pressure fluid (i.e. high relative to the fluid pressure in the head end of fluid motor 25) from the rod end fo the main fluid motor 25 will now permit the relatively low biasing pressure fluid in the head end of fluid motor 25 to advance the feed slide 28, together with the now gripped stock, through one incremental feed step in the feed direction 30. Just prior to the completion of this stock feed stroke the feed slide will operate 3-way valve 325 so as to cause pressure fluid to flow through line 313 to shift valve 312 to its closed condition wherein the normal exhaust flow through valves 314 and 305 to exhaust line 311 is flocked and now is caused to flow out through valve 312 and the exhaust the restriction 317. This suddently increased impedance to the normal exhaust flow from the rod end of fluid motor 25 will cause a rapid decelleration of the feed motion of the feed slide 28 and the attendant strip stock as said slide makes its final approach to arresting contact with the end block 23. As will be apparent the restriction 317 may be adjusted to give the desired amount of cushioning or buffering action for the terminal portion of the feed stroke feed slide 28.

As the feed slide completes its feed stroke it will also operate reverse valve 326 so as to exhaust line 333 and the control 301 thereby allowing valves 300 and 305 to sequentially shift by their return spring actions back to their respective normal closed and open conditions which will cause the stock gripping means on slide 28 to release the stock and pressure fluid to flow through line 307, valve 305, lines 310, 320, and by-pass check valve 321 to the rod end of fluid motor 25 so as to thereby cause said feed slide to move through an index stroke back to its said normal right hand (as seen in FIG. 1) position in the manner described above. When feed slide 28 moves away from the forward end block 23 in starting its said return index stroke both valves 325 and 326 will return to their said normal conditions and when feed slide 28 completes its said index stroke the control circuit 290 and the feed slide 28 will be ready for their next feed-index cycle of operation. The second semi-automatic control circuit 291, which in FIG. 1 uses the same reference numerals for corresponding parts but with a suffix "a" added, is arranged and operates similarly to that just described for circuit 290 so that when a demand feed signal or pulse is initiated in control line **301*a*, in the manner to be described below, the control circuit 291 will cause feed slide 28*a*** to move through a similar feed-index cycle of movement comprising a forward stock feed stroke and then a return index stroke back to its normal right hand position.

A demand feed signal generating means 350, FIGS. 1 and 2, is provided for directing pressure fluid pulses alternatively to one and then the other of the control lines 301 and **301*a* of said semi-automatic control circuits 290 and 291 respectively, such signal generating means including a first mechanically operated spring-returned normally-closed 2-way valve 351, FIG. 2, having an air supply inlet line 352 connected to pressure air supply source S, and an output line 353 connected to the said control line 301 for the control circuit 290. Valve 351 is adapted to be operated by a cam 354 through a conventional type valve activating cam follower 355. A second 2-way valve 360 similar to valve 351 is provided having an inlet supply line 361 that is connected to said pressure air supply line 72, and an output line 362 that is connected to the said control line 301*a* for the second semi-automatic control circuit 291. Valve 360 is adapted to be operated by a cam 364 through a conventional type valve activating cam follower 365. Cams 354 and 364 are identical and are secured to a common shaft 366 that carries an eight toothed ratchet wheel 368 that in turn is adapted to be actuated by a pawl 370 carried by the vertically reciprocatable plunger 371. The ratchet, pawl and plunger and associated actuating means here are constructed and arranged in the same manner as is described in connection with FIG. 4 of said copening application; suffice it to note here that in response to each cycle of operation of the punch press the ratchet wheel 368 will be rotatably advanced through a 45 degree step clockwise, as viewed in FIG. 1, so as to correspondingly rotatably index the two cams 354 and 364 through a 45 degree incremental step. As illustrated in FIG. 2 each of the cams 354 and 364 is formed with four small lobes 372 that are equally spaced at 90 degrees about the cam periphery, and the two cams are mutually rotatably positioned on shaft 366** in 45 degrees phase relation with respect to each other.

The ratchet wheel 368 when cyclically actuated or stepped in response to the cyclic operation of the press ram serves to rotatably index each of the cams 354 and 364 through successive 45 degree steps to eight discrete rotary positions during each revolution of the shaft 366. In each such discrete position both cam followers 355 and 364 will be positioned on the inner circular peripheral surfaces of the cams. The cams are arranged on shaft 366 so that during the time that the shaft 366 is being rotatably displaced through a first 45 degree step one of the cam lobes 372 on cam 354 will move passed follower 355 so that the 2-way valve 351 is thereby momentarily opened thus causing pressure fluid to flow into output line 353 and thus into control line 301. During the next 45 degree step of the shaft 366 one of the cams lobes 372 on cam 364 will move passed follower 365 so that the valve 364 will be momentarily opened thus causing pressure fluid to flow into output line 362 and thus into line 301*a*. As will be apparent as the shaft 366 is successively indexed through 45 degree steps a demand feed pulse or signal will be generated first in the control line 301 for the semi-automatic control circuit 290 and then in control line 301*a* for the control circuit 291, hence this alternate operation of valves 354 and 364 will produce alternate feed-index cycling of the feed units 16 and 16*a* as above described.

An alternate form of the buffer control means is illustrated in FIG. 3. Here the FIG. 1 circuit diagram is changed only as respects a replacement for valves 312 and 325 of the first control circuit 290 and a corresponding change for the control circuit 291. In that these two changes for each control circuit 290, 291 are the same an explanation of such in connection with one control circuit, 290, will suffice here. Feed slide 28 is provided with a cam 380 that is adapted during terminal portion of each feed stroke of feed slide 28 to operate a normally closed 3-way valve 381 through a conventional type one-way dog operating arrangement 382. Valve 381 has in inlet supply line 383, an output line 384 and an exhaust line 385. Output line 384 is connected to the inlet port 390 of a pressure fluid injection valve 391; the latter having a cylindrical axially movable valve element 392 that is formed with a right angled fluid conducting passage 393. The left end, as seen in FIG. 3, of passage 393 communicates with said inlet port 390 while the other end of said passage, when element 392 is displaced ot its right hand position, communicates with a port 394 formed in the side wall of the tubular valve body 395. The valve element 392 is also formed with a diametrally extending passage 396 which, when element 392 is in its normal left hand FIG. 3 position, is axially aligned with both said port 394 and an opposite second port 398 also formed in said walls of the tubular valve body 395. A spring 400 normally biases said element 392 to its left hand FIG. 3 position; the effective force of said spring being adjustable by means of screw 401. The valve ports 298 and 394 are connected to said lines 314 and 315 leading to the said rod end of said fluid motor 25. In the operation of the FIG. 3 buffer system pressure air from the rod end of fluid motor 25 will exhaust through line 315, the valve passage 396, line 314, valve 305 and exhaust line 311 during a feed stroke of said feed slide 28. When feed slide 28 approaches the end of this feed stroke cam 380 will momentarily operate valve 381 so that supply pressure fluid from supply line 383 will flow through output line 384 to the valve part 390 thereby moving the valve element 392 against the action of said spring 400 to its right hand position wherein continued normal exhaust flow through line 314 is interrupted and line pressure air from line 384 is now momentarily directed through passage 393, and line 315 into the rod end of the main fluid motor 25 thereby exerting a large buffer action for decellerating the feed stroke movement of the feed slide 28 and the associated stock. Just before feed slide 28 contacts end block 23 cam 380 will move passed dog 382 and thus valve 381 will not exhaust line 384 so that valve element 392 will be restored by spring 401 to its said normal FIG. 3 condition wherein normal exhaust of pressure fluid through said valve passage 396 and valve 305 may resume for a moment to permit the completion of the feed stroke of feed slide 28. As above indicated the level of this buffering action can be controlled by adjustment of the screw 401. A corresponding buffer control arrangement is provided for this control circuit 291. When feed slide 28 moves through a subsequent index stroke the cam 380 will move idly passed said one way dog arrangement 382 and thus valve 381 will not be operated at this time.

With the type of buffer system each feed slide may move very rapidly during most of its feed stroke but then can be rapidly decellerated by a sharp high level of buffer action for a smooth completion of each such feed stroke.

In the operation of the FIGS. 1–3 type of semi-automatic feeder arrangement any suitable intermittently operating clamp or yieldably biased means (such as illustrated at 131 of my U.S. Pat. No. 4,076,161) may be used to retain the stock in a stationary position between the time that one of the present stock gripping means releases the stock and the time that the other stock gripping means grips the stock.

I claim:

1. In a feeder for intermittently advancing stock into the work station of a punch press or the like: comprising a frame;

feed slide means carried by said frame for reciprocating movement in feed and index directions;

stock gripping means carried by said feed slide means;

a main fluid motor means for actuating said feed slide means;

second fluid motor means for actuating said stock gripping means;

control means for said fluid motor means for causing said feed slide means to move through alternate index and stock feed strokes;

said control means including a first valve means, said first valve means being adapted to normally control the exhaust of pressure fluid through said first valve means from one end of said main fluid motor means during stock feed strokes of said feed slide means;

buffer means for cushioning the terminal portions of the stock fees strokes of said feed slide means, said buffer means including secondary valve means having fluid flow restriction means, said secondary valve means when operated serving to discontinue the normal exhaust fluid flow rate through said first valve means by directing exhaust flow through said restriction means whereby the resultant increased impedance to said exhaust flow from said one end of said main fluid motor means affords a cushioning action of the movement of said feed slide means; and sensing means adapted to be actuated in response to the terminal portion of a stock feed stroke of said feed slide means for operating said secondary valve means thereby affording a cushioning action for the said terminal portion of said feed stroke of the feed slide means.

2. Apparatus as defined by claim 1 wherein said secondary valve means includes a piloted three-way valve 3. Apparatus as defined by claim 1 wherein said sensing means includes a three-way valve that is adapted to be actuated by said feed slide means during a terminal portion of a feed stroke of the latter.

4. Apparatus as defined by claim 1 wherein said main fluid motor means includes a double-acting fluid motor having a rod end and a head end, pressure fluid being exhausted from said rod end during said stock feed stroke of said feed slide means.

5. Apparatus as defined by claim 1 wherein said feed slide means includes a pair of alternatively acting feed slides each carrying stock gripping means, wherein said main fluid motor means include a pair of fluid motors for respectively actuating said pair of feed slides, and wherein each of said main fluid motors is provided with said buffer means.

6. In a feeder for intermittently advancing stock into the work station of a punch press or the like: comprising a frame;

feed slide means carried by said frame for reciprocating movement in feed and index directions;

stock gripping means carried by said feed slide means;

a main fluid motor means for actuating said feed slide means;

second fluid motor means for actuating said stock gripping means;

control means for said fluid motor means for causing said feed slide means to move through alternate index and stock feed strokes;

said control means including a first valve means, said first valve means being adapted to normally control the exhaust of pressure fluid through said first valve means from one end of said main fluid motor means during stock feed strokes of said feed slide means;

buffer means for cushioning the terminal portions of the stock feed strokes of said feed slide means, said buffer means including supplementary valve means for the operative coupling to a source of pressure fluid and adapted when operated to discontinue the normal exhaust fluid flow from said one end of said main fluid motor means through said first valve means and to direct pressure fluid from said source through said supplementary valve means back into the said end of said main fluid motor means; and momentary actuating means responsive to the terminal portion of a feed stroke of said feed slide means for momentarily operating said supplementary valve means so as to provide a high momentary cushioning action for said feed slide means during the terminal portions of the feed strokes thereof.

* * * * *